US005235883A

United States Patent [19]

Jeske et al.

[11] Patent Number: 5,235,883

[45] Date of Patent: Aug. 17, 1993

[54] SORTING APPARATUS FOR FLAT BLANKS

[75] Inventors: Erwin Jeske, Neuffen; Manfred Ott, Dettingen/Teck, both of Fed. Rep. of Germany

[73] Assignee: bielomatik Leuze GmbH & Co., Fed. Rep. of Germany

[21] Appl. No.: 537,488

[22] Filed: Jun. 13, 1990

[30] Foreign Application Priority Data

Jun. 22, 1989 [DE] Fed. Rep. of Germany ..... 3920417

[51] Int. Cl.[5] ..... B31B 1/16

[52] U.S. Cl. ..... 83/80; 83/106; 83/107; 271/303

[58] Field of Search ..... 83/104, 106, 107, 80; 271/302, 303, 69

[56] References Cited

U.S. PATENT DOCUMENTS

| | | | |
|---|---|---|---|
| 2,617,528 | 11/1952 | Moore | 209/111 |
| 2,793,662 | 5/1957 | Öholm | 83/106 |
| 3,148,783 | 9/1964 | Michaels | 214/11 |
| 3,264,917 | 8/1966 | Califano et al. | 83/106 |
| 3,362,304 | 1/1968 | Skolnick . | |
| 3,693,486 | 9/1972 | Maniaci et al. | 83/88 |
| 4,265,152 | 5/1981 | Corradi | 83/106 |
| 4,367,997 | 1/1983 | Schweingruber | 414/38 |
| 4,976,089 | 12/1990 | Reichelt | 53/53 |
| 5,035,164 | 7/1991 | Cremona | 83/80 |

FOREIGN PATENT DOCUMENTS

| | | | |
|---|---|---|---|
| 0155205 | 3/1989 | European Pat. Off. . | |
| 1297979 | 1/1966 | Fed. Rep. of Germany . | |
| 2042243 | 3/1972 | Fed. Rep. of Germany | 271/303 |
| 2132400 | 1/1973 | Fed. Rep. of Germany . | |
| 2421610 | 11/1974 | Fed. Rep. of Germany . | |
| 2728016 | 1/1979 | Fed. Rep. of Germany . | |
| 354350 | 5/1979 | Fed. Rep. of Germany . | |
| 2916518 | 8/1980 | Fed. Rep. of Germany . | |
| 3128680 | 2/1983 | Fed. Rep. of Germany . | |
| 2085412 | 4/1982 | United Kingdom . | |

OTHER PUBLICATIONS

Patent Abstracts of Japan, vol. 12, No. 81. Appl. JP 860279834, Appl. JP 810105820, Appl. JP 860064354.

Miller, Lee D.: Ways to Change Direction of Conveyed Materials. Automation, Sep. 1965, pp. 102 and 107.

*Primary Examiner*—Mark Rosenbaum
*Assistant Examiner*—John M. Husar
*Attorney, Agent, or Firm*—Quarles & Brady

[57] ABSTRACT

In a sorting apparatus (1) for separating faulty blanks (16') from the remaining blanks (15,16), which have been produced from a paper web (14) by a cutting mechanism, is provided a sorting gate (17) with separately operating, juxtaposed individual gates (18,19) for each of the parallel web strands. By individual gates (25,26) of a following distributing gate (22), it is possible to compensate differences in the numbers of blanks of the two web strands leaving the sorting gate (17). On overlapping and collecting stations (31,33 or 32,34) following the distributing gate (22) each web strand has separately controlling units, so that all the stacks are produced independently of one another and can be conveyed on after production.

27 Claims, 1 Drawing Sheet

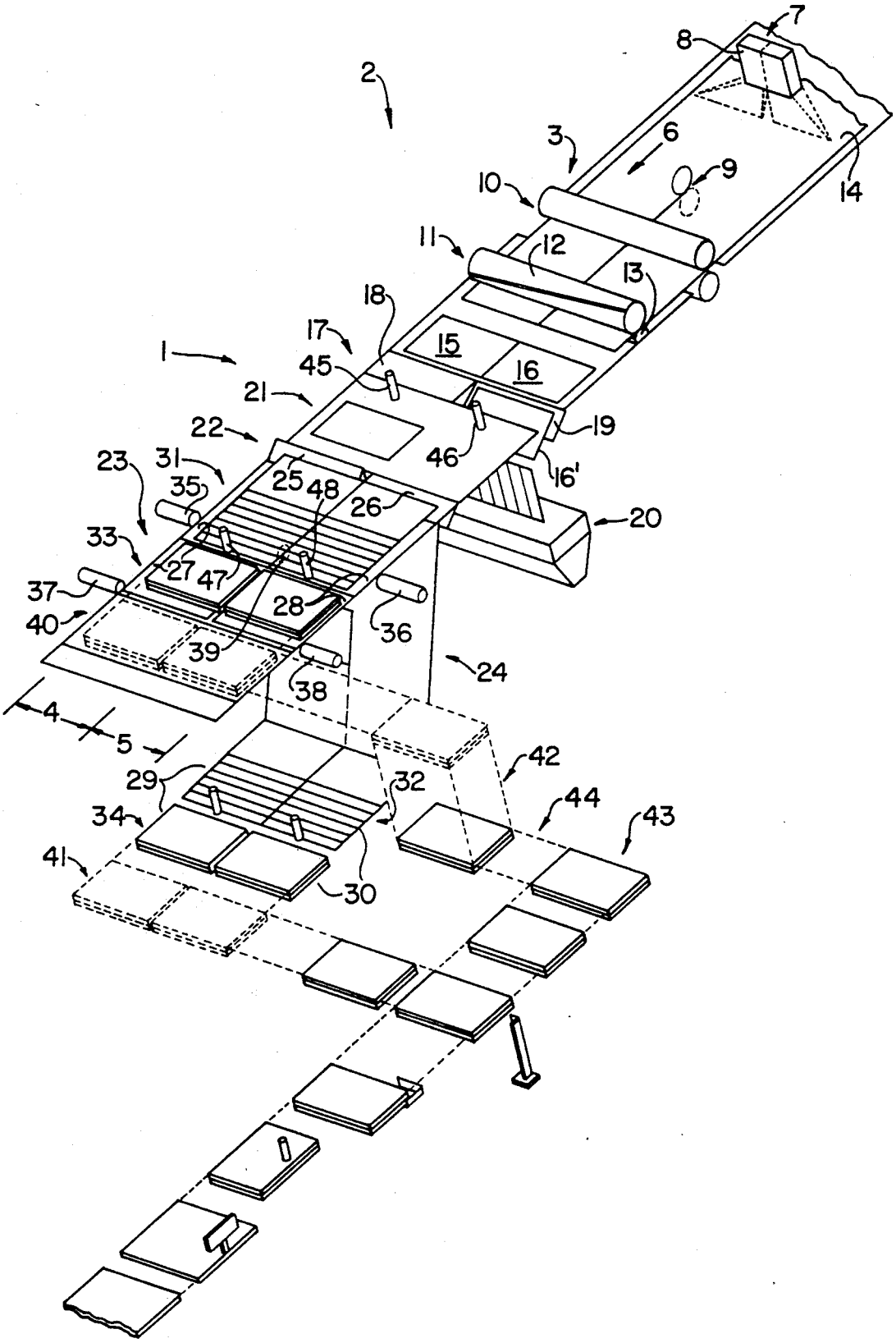
7
8
2
3
6
9
10
14
11
12
13
18
17
15
16
1
45
21
19
22
46
16'
23
31
25
48
26
20
35
33
27
47
37
28
36
40
39
24
38
4
5
42
29
32
44
43
34
41
30

SORTING APPARATUS FOR FLAT BLANKS

BACKGROUND OF THE INVENTION

The invention relates to a sorting apparatus for flat blanks, e.g. paper sheets, to be checked e.g. for specific quality features or defects, and more particularly, top quality papers, such as art papers, security papers for cheques, banknotes, etc.

Such sorting apparatuses appropriately have at least one movement path for the individually following blanks, which during the passage differ optically or according to specific criteria and e.g. are so separated that blanks with specific features are separated from at least one group not having such features. In order to increase the throughput of the sorting apparatus, at least initially, the blanks are moved in at least two juxtaposed paths and sorting can simultaneously take place in juxtaposed manner on all the paths.

Such sorting apparatuses suffer from the disadvantage that adjacent blanks can only be moved on together at the sorting point, e.g. sorted out, even if only a single blank has the corresponding feature. Therefore the thus sorted out blanks subsequently have to be manually resorted to bring about a clear separation according to categories. If e.g. sorting is based on defects, then in the case of a twin operating procedure per sorting process the amount of waste is increased by twice what is necessary if only one blank has a defect during each sorting process. The aforementioned subsequent sorting is complicated, cost-intensive and error-prone, because it requires high concentration.

SUMMARY OF THE INVENTION

An object of the invention is to provide a sorting apparatus of the aforementioned or a similar type, which makes it possible in a simple manner to separate blanks running in separate paths independently of one another and in accordance with predetermined criteria.

According to the invention this object is achieved in that in the vicinity of the sorting points means are provided, which can be reversed in such a way that at least two of these blanks are either moved in a reciprocally substantially identical position or are transferred into a relative movement with respect to one another, which leads to a sorting process. If the sorting point is formed by a gate guiding or deflecting in mechanical manner the blanks, then said sorting gate is subdivided into separate individual gates for in each case one of the blanks or numerous groups thereof. Independently of one another the individual gates can be changed into at least two gate positions. Thus, in accordance with requirements, the blanks can either be moved on in the same way or can be moved out individually or in groups on the basis of one or more differentiating features. Thus, if the sorting process is e.g. used for eliminating waste, then only the faulty blanks are sorted out and collected separately from the perfect blanks.

The described construction can be advantageous for the solution of the set problem in itself or additionally also for another gate, e.g. for a distributing gate, which can distribute the blank stream by reversal over two or more continuing path portions. By splitting the distributing gate in the described or a similar manner, it is e.g. possible to compensate differences in the number of the streams of blanks moved side by side in the preceding path portion in such a way that in at least in one continuing path portion the number of blanks in the parallel paths is the same independently of whether the blanks arrive in the paths in the same or different numbers upstream of the distributing gate.

Furthermore, for achieving the object, instead of or in addition to the described constructions, means can be provided through which the blanks in the parallel flows of singly or groupwise parallel blanks with different speeds can e.g. be moved in such a way that one flow stops, while the other flow is running. In the case of mechanical conveying this is preferably achieved in that the associated conveying path is subdivided into juxtaposed single conveying paths of corresponding width, said individual conveying paths being driven at varying speed or stopped independently of one another, although the two flows previously ran in synchronously juxtaposed form.

For bringing together the blanks belonging to one another as a result of the indicated criteria, there is appropriately at least one collecting station, in which the blanks are e.g. stacked on one another in edge-flush stack form. Said collecting station or stations are appropriately provided just behind the distributing gate in the running direction and the collecting station can advantageously have upstream thereof and directly adjacent thereto an overlapping station, in which the initially spaced successively moved blanks are initially placed in overlapping scale or flake-like manner on one another in the running direction with most of the associated extension. The transfer to the collecting station takes place from said overlapping station.

Instead of or in addition to the described construction, means can be provided for the independent or separate counting of the blanks moved in the juxtaposed streams, the relative count result of the two counts being used as a signal for reversing the individual gates or for driving the individual conveying paths. Appropriately counting takes place both directly downstream of the sorting gate in the flow belonging to each individual gate and directly before placing in the collecting station separately in each flow. This makes it possible to establish whether between the succeeding counting zones in the running direction one or more blanks has gone astray or been removed, which is particularly important when processing security papers.

Following sorting, distributing or collecting the blanks are moved laterally outwards, preferably in stackwise manner by appropriate means at right angles to the previously prevailing running direction, so that they can be easily transferred to a further extending conveying means, whose conveying direction is preferably approximately parallel to said prevailing running direction. In said conveying means in the conveying direction the blanks or stacks of sheets can be successively fed into separate collecting stations, which are supplied with blanks by the common distributing gate.

The inventive sorting apparatus is particularly suitable for so-called sorting transverse cutters, in which initially a web supplied from a reservoir in its longitudinal direction is longitudinally cut for subdividing juxtaposed useful webs and optionally can be cut on its edges and then by transverse cutting subdivided into the individual, juxtaposed blanks. This transverse cutting and optionally a pulling apart of successive blanks in the running direction can take place directly upstream of the sorting gate with whose individual gates the blank to be removed can then be led out downwards out of the main path, whilst the blanks not to be removed continue on substantially linearly over the sorting gate.

Checking according to the aforementioned criteria appropriately takes place just prior to longitudinal cutting and the material web on either side of the separating line defined by the longitudinal cut is separately checked, so that said features can be determined independently of one another on either side of the separating line. Advantageously a web inspection system is provided, which functions in incident, transmitted or reflected light as a function of requirements and whose checking cells located on either side of the separating line control a separate control unit. The individual gates or individual conveying paths can be controlled directly by said control unit in an automatic manner for obtaining the described effects. The individual gates of the distributing gate are appropriately controlled via separate counting mechanisms of the upstream counting zone.

As a result of the inventive construction only the faulty sheet is discharged as waste. This ensures that only faulty sheets are removed as waste, so that no subsequent manual sorting is required and consequently the efficiency of the apparatus can be considerably increased. The inventive construction is also suitable for materials other than webs.

The inventive apparatus can operate according to a method, in which of at least two parallel material streams on at least a portion of the individual path the streams from a common supply can be moved differently, but in parallel manner. With said common portions of the material streams is associated a branch with at least two further identical partial sections in such a way that the material streams can be continued on one of the two branched paths independently of one another and in reversible manner, so as to compensate quantity differences resulting from the different path of the juxtaposed material streams. Thus, independent random influencing is possible of the quantities of the juxtaposed material streams occurring at the ends of the branching section. The ends of the branching sections are then appropriately so connected to a common outlet that the material quantities or stacks collected in the branching section from the material stream are successively supplied to the outlet. In the case of a sorting apparatus there can be two narrow separate sorting devices in directly juxtaposed form and their overlapping or collecting stations are connected to the common outlet via common transverse conveying means and optionally at least one lifting mechanism.

BRIEF DESCRIPTION OF THE DRAWINGS

These and further features of preferred developments of the invention can be gathered from the claims, description and drawing. The individual features can be realized singly or in the form of subcombinations in an embodiment of the invention and in other fields and can represent advantageous, independently protectable constructions for which protection is hereby claimed. An embodiment of the invention is shown in the drawing and is described hereinafter. The drawing shows an inventive sorting apparatus as a component of a sorting cutter in a partly simplified perspective view.

DETAILED DESCRIPTION OF THE PREFERRED EMBODIMENTS

At the end of a first conveying section of a conveyor 3 of the cutting mechanism of a sorting cutter 2 there is a sorting apparatus 1 allowing the removal from further processing of those blanks produced by the cutting mechanism and which have been recognized as waste and which are supplied to a waste stack, whereas the remaining blanks are conveyed on for further processing and are initially overlapped in the different planes and collected in a number of stacks, which is higher by an integral multiple than the number of useful widths 4,5 produced by the cutting mechanism.

In the represented embodiment, in which the horizontal conveyor 3 having conveyor belts e.g. passing round rollers conveys in arrow direction 6, a checking or inspection device 7 is provided, which e.g. has a checking or inspection head located above the conveyor 3 with at least one checking or inspection unit 8 for each useful width 4,5, so that independent checking can take place on each of the latter. The checking device 7 is followed in the conveying direction 6 by a longitudinal cutter 9, which centrally splits with a longitudinal cut the material or paper web 14 running on conveyor 3, so that two juxtaposed individual webs are formed. Laterally adjacent to the longitudinal cutter 9 are provided not shown edge cutters, with which the web 14 is cut to the desired width along the longitudinal edges. The longitudinal cutter 9 and edge cutter are followed by a web draw-in device 10 e.g. having two superimposed conveying rollers and with which the web 14 is drawn from a paper reel and moved through the checking device 7 or the transverse cutter 9. Upstream of the transverse cutter the conveyor is formed not by conveyor belts, but by freely rotating rollers, support plates, etc.

In the conveying direction 6 the web draw-in device 10 is followed by a transverse cutter 11, which appropriately has two superimposed cutting tools, whereof preferably one and in particular the lower one is e.g. constructed as a fixed, ledge-like lower knife 13 and the other as a cutting roller 12. The longitudinally split web 14 passing between the cutting tools is transversely cut by the transverse cutter 11 into two oriented, juxtaposed, equally large blanks 15,16, which following transverse cutting are so advanced by corresponding acceleration that successive blank pairs separate from one another in contact-free manner and can follow at a limited distance.

Directly following onto the transverse cutter 11 or the device for drawing apart the blank pairs, the conveyor 3 operating identically over the entire web width is connected to a sorting gate 17, which has a separate and separately reversible individual gate 18,19 for each of the two juxtaposed, synchronously running blank streams. The two substantially identical individual gates 18,19 are so constructed that they can deflect each individual blank 15 or 16 of the stream at right angles to the plane of conveyor 3 either downwards to a waste collector 20 or can move it on in the conveying direction of arrow 6 to a conveyor 21 located above the same and located roughly in the plane of conveyor 3. The conveyor 21 appropriately operates in an identically synchronous manner over all the useful widths 4,5.

In the conveying direction, conveyor 21 is followed by a distributing gate 22, which passes the parallel material streams either in the direction of arrow 6 to a following conveyor path 23 located roughly in the plane of conveyor 3 or conveyor 21, or at right angles to said plane e.g. downwards onto a branch conveyor path 24. For each useful width 4 or 5, the distributing gate 22 also has a separate individual gate 25 or 26, so that each individual incoming blank can either be passed on or diverted. The identically constructed individual gates 25,26 can e.g. have as movable guide or gate bodies for the blanks an acute-angled wedge profile at right angles to the conveying direction and whose wedge apex connected to conveyor 21 is directed roughly counter to the conveying direction. In one gate position the wedge apex is located in the conveying plane, so that the upper wedge flank passes on the blank and in the other gate position the wedge apex is raised above the conveying plane, so that the particular blank runs onto the lower wedge flank and is diverted downwards onto conveying path 24. The gate bodies are pivotable about a common axis parallel to the conveying plane and at right angles to the conveying direction and located directly adjacent to the conveying path 23 in the vicinity of the wedge edge remote from the wedge apex. Although shown differently in the drawing, appropriately the individual gates of the sorting gate 17 and distributing gate 22 are identically constructed. In the drawing the right-hand individual gate 18 of the sorting gate 17 relative to conveying direction 6 is represented in such a way that the associated blank 15 is transferred to the conveyor 21 and the left-hand individual gate 19 is shown in such a way that an associated blank 16' is deflected downwards. Relative to the distributing gate 22 the right-hand individual gate 25 is shown in such a way that the associated blank 15 is deflected downwards, while the left-hand individual gate 26 passes on the associated blank. The two conveying paths 23,24 diverge heightwise upwards and downwards roughly by the same amount with respect to the conveying level of conveyor 21 and which is consequently roughly in a median plane between the conveying paths 23,24.

The distributing gate 22 is directly followed in the conveying direction by an overlapping station 31 located in the plane of the conveyor 3 and in which the blanks of each of the two juxtaposed streams thereof with separate overlapping units can be placed on one another in scale or flake-like manner by suitable acceleration or deceleration. A corresponding overlapping station 32 at right angles to the conveying plane 3 and which is vertically displaced or below the same is also associated with the conveying path 24 and appropriately with respect to the overlapping station 31 is positioned vertically above the same or displaced by at least one useful length in or counter to the conveying direction. The overlapping station 32 also having separate, juxtaposed overlapping units and parallel or horizontal to overlapping station 31 is connected by means of an inclined intermediate conveying section overcoming the height difference to the distributing gate 22. On said conveying section the blanks of the two parallel machine streams can be moved independently of one another. If the intermediate conveying section has a driven conveyor, then the latter is appropriately formed by independently driveable, juxtaposed individual conveyors.

Directly following each overlapping station 31 or 32 in the conveying direction is provided a collecting station 33 or 34, to which are independently transferred the overlapped blanks of each blank stream and are independently formed into separate, edge-flush stacks, so that each collecting station 33 or 34 has juxtaposed, separate and independently operating collecting units for the blank streams.

Each overlapping unit and the associated collecting unit form at least one separately driveable and controllable individual conveying path 27,28 or 29,30 of the associated conveying path 23 or 24. Appropriately the conveying sections following one another in the conveying direction and belonging to the particular overlapping unit and the collected collecting unit are formed by separately controllable or driveable individual conveyors. The juxtaposed individual conveyors of the overlapping station 31 have separate drives 35,36, while the juxtaposed individual conveyors of the collecting station 33 have separate drives 37,38. Corresponding, not shown separate drives are also provided for the individual conveyors of the overlapping station 32 and the collecting station 34. The juxtaposed overlapping units and/or the juxtaposed individual conveyors or their drives are appropriately rigidly couplable together by means of a clutch 39, so that they can be driven precisely synchronously. This leads to a higher working accuracy in certain cases. For example the sorting apparatus 1 or the sorting cutter 2 can be operated in single-use manner, i.e. no longitudinal cutting takes place and instead the longitudinal cutter 9 remains out of operation, without there being any risk of the wider blank which is then moved by two juxtaposed individual conveyors passing in tilted manner into the overlapping section as a result of running inaccuracies of said two individual conveyors.

Each collecting station 33 or 34 is directly followed by a transverse conveyor 40 or 41, to which the blank stack of juxtaposed collecting units is independently transferred by their individual conveyors and can then be moved on at right angles to the conveying direction of arrow 6, but parallel to the plane of the conveyor. The two super-imposed transverse conveyors 40,41 of the two conveying paths 23,24 convey in the same transverse direction, but are reciprocately displaced in the direction of arrow 6, in the manner described relative to the overlapping stations 31,32 or the collecting stations 33,34. Appropriately in order to obtain the displacement between an overlapping station and the associated collecting station a correspondingly extended intermediate section is provided. The upper transverse conveyor 40 issues laterally adjacent to the conveying path 24 or to the overlapping station 32 into a lifting mechanism 42, e.g. a sheer lifting table, with which the associated blank stack can be lowered from the level of the transverse conveyor 40 to the level of the transverse conveyor 41. The lowered stacks are transferred via an intermediate conveyor 44 in the transverse conveying direction to a conveying means 43, which supplies the stacks or packs of sheets roughly parallel to conveying direction 6 for further processing purposes. The conveying means 43 is appropriately level with the collecting station 34 or the transverse conveyor 41, which transfers the stacks supplied thereto directly to the conveying means 43 at a point which, in the conveying direction, is displaced with respect to the transfer point by the intermediate conveyor 44.

According to the invention for the parallel blank streams there are separately, independently functioning counting mechanisms 45,46 or 47,48. Appropriately, for the blanks of each stream, directly following the sorting gate 17 and in the vicinity of the conveyor 21 is provided a counting mechanism 45 or 46. Corresponding separate counting mechanism 47,48 of a further counting system operate prior to the deposition of the overlapped blanks in the collecting station 33 or 34, so that with each collecting unit is associated a separate counting mechanism. Corresponding separate counting mechanisms can also be provided in the area between the sorting gate 17 and the waste collector 20.

If, as shown in the drawing, a defect is found in the left-hand strand of web 14, then, following its detection, it is electronically so further processed by the associated checking or inspection unit 8, that the associated individual gate 19 of the sorting gate 17 as a function of the blank length changes the conveying speed and the distance of the checking device 7 from the sorting gate 17 in such a way that precisely when the defective blank 16' arrives the individual gate 19 is switched to the discharge position and said blank 16' is supplied to the waste stack. The other individual gate 18 remains in its normal position, in which the associated blank is supplied to the overlapping station and then the collecting station.

Thus, blanks with different intermediate spacings arrive in the overlapping units of the overlapping station 31, which could impair the overlapping process. Thus, in the described case, by means of a corresponding clutch of drive 36, the left-hand overlapping section is briefly stopped, so as to compensate the increased spacing between successive blanks 16 resulting from the discharge of blanks 16'. It is also possible for the two individual stacks from the collecting stations 33 or 34 to arrive at their predetermined blank number of e.g. 500 in time-succeeding manner instead of at the same time as a result of the discharge of individual blanks, so that they are transferred in time-succeeding manner to the associated transverse conveyor 40 or 41. This is possible through the separately driveable individual conveyors of collecting stations 33,34.

If it is established by a counting mechanism 45 or 46 of the first counting system that the number of blanks for a stack has passed through and is therefore supplied to the associated collecting unit of the collecting station 33, then following the passage of the last blank through the associated individual gate 25 or 26 of the distributing gate 22 said individual gate is switched over in such a way that the further blanks are deflected to the conveying path 24 and are consequently supplied to the associated collecting unit of the further collecting station 34. The overlying stack can be transferred from the collecting station 33 to the associated transverse conveyor 40 and passed on via the lifting mechanism 42 to the conveying means 43. Thus, as on both web sides and independently of one another the blanks can travel on upstream of the distributing gate 22 or the overlapping and collecting station while a stack is completely produced and transferred by the associated collecting unit, an uninterrupted operation at very high speed is ensured. The inventive apparatus is very reliable in operation, has a simple and space-saving construction.

In the discharge path following the individual gate 18 or 19 of the sorting gate 17 can be provided a blank destroying means for the removed blanks, which e.g. cuts said blanks into strips on passing through the associated individual gate or immediately after leaving the same, so that in an advantageous manner a misuse of discharged blanks is prevented. Component 20 can be a mechanism for the further size reduction or destruction of these strips.

We claim:

1. A sorting apparatus for flat sheets comprising:

conveyor means for conveying the sheets in at least one sheet line in a conveying direction, said sheets being spaced in said sheet line to provide spaced single sheets;

at least one selecting means for alternately guiding the sheets of said at least one sheet line to one of at least two at least partially separate paths of said conveyor means, each of said paths providing separate intermediate sheet collecting means to create separate intermediate sheet accumulations by bringing the sheets together towards an at least partially stacked conveying condition; and means for recollecting the intermediate sheet accumulations in said at least partially stacked conveying condition downstream of said separate intermediate sheet collecting means on a common conveying means to which the intermediate sheet accumulations are supplied by at least two of said separate paths.

2. The sorting apparatus according to claim 1, wherein control means are provided for delivering each of said separate sheet accumulations to said common conveying means upon detecting a predetermined amount of sheets in each of said separate sheet accumulations.

3. A sorting apparatus for flat sheets comprising:

a conveyor means for conveying the sheets in at least one sheet line in a conveying direction;

at least one sorting means for guiding defective ones of the sheets to a waste receiving means and for guiding remaining sheets of said at least one sheet line to a conveying path of said conveyor means; and at least one distributing means for transferring said remaining sheets to at least two separate individual conveyor paths, each path issuing into a separate sheet collecting means for creating sheet accumulations.

4. The sorting apparatus according to claim 3, wherein said conveying means defines a conveyor plane, at least one of units provided by said separate path and said individual sheet collecting means being offset with respect to each other and transverse to said conveying plane.

5. The sorting apparatus according to claim 3, wherein separate control means are provided for operating said sorting means and said distributing means.

6. The sorting apparatus according to claim 3, wherein at least one of said individual sheet collecting means has at least one of units provided by an overlapping means for partially overlapping the sheets and a sheet stacking means for stacking said sheets into intermediate stacks.

7. The sorting apparatus according to claim 6, wherein at least two of said units are superimposed.

8. The sorting apparatus according to claim 6, wherein at least one of said units directly follows said distributing means.

9. The sorting apparatus according to claim 6, wherein in at least one of said separate conveyor paths, each of said units provides separately drivable conveying drive means.

10. The sorting apparatus according to claim 3, wherein upstream of said at least one sorting means is provided a web transverse cutter and downstream of said sorting means is provided at least one presence detecting means for detecting presence and absence of sheets in a passing sheet stream.

11. The sorting apparatus according to claim 3, wherein a feature detecting means for detecting selected features of said sheets in said one sheet line is provided, at least one detecting unit of said detecting means being followed downstream by at least one presence detecting means for detecting presence and absence of sheets in a passing sheet stream.

12. The sorting apparatus according to claim 11, wherein said detecting unit is constructed to operate by at least one of functions provided by an incident, transmitted and reflected ray function.

13. A sorting apparatus for flat sheets comprising:

a conveyor means defining at least two laterally juxtaposed conveyor lines for conveying the sheets in at least two juxtaposed sheet lines and substantially in a common conveying plane and a common conveying direction; and at least one of units provided by sorting means for guiding defective ones of the sheets of at least two of said sheet lines to a waste receiving means, distributing means for transferring said sheets to at least two separate conveyor paths, laterally juxtaposed sheet collecting means for creating laterally juxtaposed sheet accumulations, accumulation conveying means for conveying accumulations of collected laterally juxtaposed sheets in directions corresponding to at least one of three spacial axes and at least one conveyor section operable for conveying sheets independent from a diverted conveyor section, wherein at least two of said at least two laterally juxtaposed conveyor lines are provided to be separately conveyingly driven.

14. The sorting apparatus according to claim 13, wherein at least one of said juxtaposed conveyor lines provides at least two chaining conveyor sections, each of said conveyor sections being conveyingly drivable independently from each other.

15. The sorting apparatus according to claim 13, wherein said distributing means provide separate individual distributing gates for each of said sheet lines, control means being provided for operating said distributing gates independently from each other.

16. A sorting apparatus for flat sheets comprising:

a conveyor means defining at least two chaining conveying sections for conveying the sheets in at least two laterally juxtaposed sheet lines in a conveying direction and at least one of operating units provided by a sorting means for guiding defective ones of the sheets of said at least two sheet lines to a waste receiving means, distributing means for transferring said sheets to at least two following separate conveyor paths following said chaining conveyor sections downstream, sheet collecting means for creating sheet accumulations, accumulation conveying means for conveying accumulations of collected sheets in directions corresponding to at least two of three spacial axes, and sheet counting means for counting the sheets in said at least two sheet lines, wherein at least two of said chaining conveyor sections of said at least two sheet lines are conveyingly driveable independently from each other.

17. A sorting apparatus for flat sheets comprising:

a conveyor means defining at least two chaining conveyor sections for conveying the sheets in at least one sheet line in a conveying direction; and at least one of operating units provided by a juxtaposed further sheet line, sorting means for guiding defective ones of the sheets of said sheet line to a waste receiving means, distributing means for transferring said sheets to at least two following separate conveyor paths, sheet collecting means for creating sheet accumulations, accumulation conveying means for conveying accumulations of collected sheets in directions corresponding to at least one of three spacial axes, and control means for operating at least two of said at least two chaining conveyor sections independently from one another;

and sheet counting numbered amounts of sheets while passing for counting sheets in said sheet line and said conveyor sections.

18. The sorting apparatus according to claim 17, wherein said counting means counts downstream of said distributing means and upstream, directly adjacent to said sheet collecting means.

19. A sorting apparatus for flat sheets comprising:

a conveyor means defining at least two separate conveyor paths issuing from a common conveyor path for conveying the sheets in at least two diverted laterally juxtaposed and coplanar sheet lines in a conveying direction; and at least one of operating units provided by sorting means for guiding defective ones of the sheets of said sheet lines to a waste receiving means, distributing means following said sorting means for distributing and transferring said sheets to at least two following separate conveyor paths for the sheets provided by separate conveyors, sheet counting means for counting the sheets in said sheet lines and control means for operating said separate conveyor paths, wherein said separate conveyors issue into a common conveyor line downstream of at least one of said operating units.

20. The sorting apparatus according to claim 19, wherein said conveyor paths issue from a common sheet line via at least one selecting means operable for alternately guiding spacedly following ones of the sheets to said conveying paths.

21. The sorting apparatus according to claim 19, wherein said conveyor paths issue into said conveyor line via at least one of separate conveyors provided by a lift conveyor means and a transverse conveyor transverse to and substantially coplanar with said conveyor line.

22. The sorting apparatus according to claim 21, wherein said separate conveyors are directly following an associated sheet collecting station provided by said sheet collecting means.

23. The sorting apparatus according to claim 21, wherein separate transverse conveyors issue into said common conveyor line at regions displaced with respect to one another in a conveying direction of said conveyor line.

24. The sorting apparatus according to claim 21, wherein said lift conveyor means provides a lift conveyor located between said transverse conveyor and said common sheet conveyor line.

25. A sorting apparatus for flat sheets comprising:

a conveyor means defining a conveying plane and at least two separate conveying paths offset with respect to each other and one being substantially transverse to said conveying plane for conveying the sheets in at least two diverted and laterally juxtaposed sheet lines in a conveying direction; and at least one of operating means provided by sorting means for guiding defective ones of the sheets of said sheet lines to a waste receiving means, distributing means for transferring said sheets to at least two following separate conveyor paths, sheet collecting means for creating sheet accumulations, accumulations conveying means for conveying accumulations of collected sheets in directions corresponding to at least one of three spacial axes, sheet counting means for counting the sheets in said sheet lines and control means for operating at least one conveyor section of said conveyor means, wherein said separate conveyor paths separately issue in a downstream direction at substantially a same height level and a common transverse conveying plane into a common sheet conveyor line by laterally conveying transverse to said conveying direction and substantially parallel to said common transverse conveying plane, said common sheet conveyor line being laterally offset with respect to said at least two separate conveying paths and substantially parallel to said conveying plane.

26. A sorting apparatus for flat sheets comprising:

a conveyor means defining at least two diverted conveyor lines for conveying the sheets in at least two diverted sheet lines in a conveying direction; and drive means for drivingly operating at least two of said at least two conveyor lines, wherein control means are provided for operably driving said conveyor lines selectively commonly by a drive interconnection between said conveyor lines disconnecting and separately by.

27. A sorting apparatus for flat sheets comprising:

a conveyor means for conveying these sheets in at least one sheet line in a conveying direction;

at least one sorting means for guiding defective ones of the sheets to a waste receiving means and for guiding remaining sheets of said at least one sheet line to a conveying path of said conveyor means;

at least one distributing means for transferring said remaining sheets to at least two separate conveyor paths, each path issuing into a separate sheet collecting means for creating intermediate sheet accumulations; and means for recollecting the intermediate sheet accumulations downstream of said separate intermediate sheet collecting means on a common conveying means to which said intermediate sheet accumulations are supplied by said at least two separate paths.

* * * * *